US009932698B2

(12) United States Patent
Catallo

(10) Patent No.: US 9,932,698 B2
(45) Date of Patent: Apr. 3, 2018

(54) DEVICE FOR ALLOWING NARROW COLLAR MATERIAL TO BE PROCESSED THROUGH A STANDARD FABRIC COMPACTOR

(71) Applicant: Teresa Catallo, Old Westbury, NY (US)

(72) Inventor: Frank Catallo, Old Westbury, NY (US)

(73) Assignee: Teresa Catallo, Old Westbury, NY (US)

( * ) Notice: Subject to any disclaimer, the term of this patent is extended or adjusted under 35 U.S.C. 154(b) by 446 days.

(21) Appl. No.: 14/788,957

(22) Filed: Jul. 1, 2015

(65) Prior Publication Data

US 2017/0002490 A1 Jan. 5, 2017

(51) Int. Cl.

| | |
|---|---|
| ***D06C 21/00*** | (2006.01) |
| ***B65H 23/022*** | (2006.01) |
| ***D06C 3/00*** | (2006.01) |
| ***D06C 5/00*** | (2006.01) |

(52) U.S. Cl.

CPC ..... *D06C 21/00* (2013.01); *B65H 23/022* (2013.01); *D06C 3/00* (2013.01); *D06C 5/00* (2013.01); *B65H 2406/113* (2013.01); *B65H 2515/842* (2013.01); *B65H 2701/132* (2013.01); *B65H 2701/174* (2013.01)

(58) Field of Classification Search

CPC . D06C 3/00; D06C 7/00; D06C 25/00; D06C 21/00; B65H 20/14; B65H 51/16; B65H 23/24; B65H 2406/113; B65H 23/022; B65H 2701/132; F26B 3/04; F26B 13/007; F26B 13/101; F26B 13/108; F26B 21/004; F26B 21/00; D06F 73/00

USPC ..... 26/98, 71, 87, 106, 51; 226/7, 97.1, 226/97.3; 242/615.11; 34/461

See application file for complete search history.

(56) References Cited

U.S. PATENT DOCUMENTS

| | | | | |
|---|---|---|---|---|
| 2,060,430 A * | 11/1936 | Spooner | D06B 5/00 118/68 |
| 2,747,250 A | 5/1956 | Bramhall | |
| 2,848,820 A * | 8/1958 | Wallin | B65B 41/12 226/7 |
| 3,142,107 A * | 7/1964 | Wittig | B65H 23/34 112/DIG. 2 |
| 3,274,697 A * | 9/1966 | Aronsson | D21F 5/00 34/451 |

(Continued)

*Primary Examiner* — Amy Vanatta

(74) *Attorney, Agent, or Firm* — Charles E. Baxley

(57) ABSTRACT

A device that attaches to a standard fabric compactor and allows narrow collar material to be processed through the standard fabric compactor. The device includes a pair of air openers. Each air opener includes an air inlet assembly and an air outlet assembly. The air inlet assembly of each air opener pulls air therein to form pulled air and pressurizes the pulled air to form pressurized air. The air outlet assembly of each air opener fluidly communicates with the air inlet assembly of an associated air opener, receives the narrow collar material therethrough, receives the pressurized air from the air inlet assembly of the associated air opener, and directs the pressurized air onto the narrow collar material, simultaneously from above and below, and in doing so, suspends the narrow collar material allowing the narrow collar material to be processed through the standard fabric compactor.

17 Claims, 3 Drawing Sheets

(56) References Cited

U.S. PATENT DOCUMENTS

Figure 1:
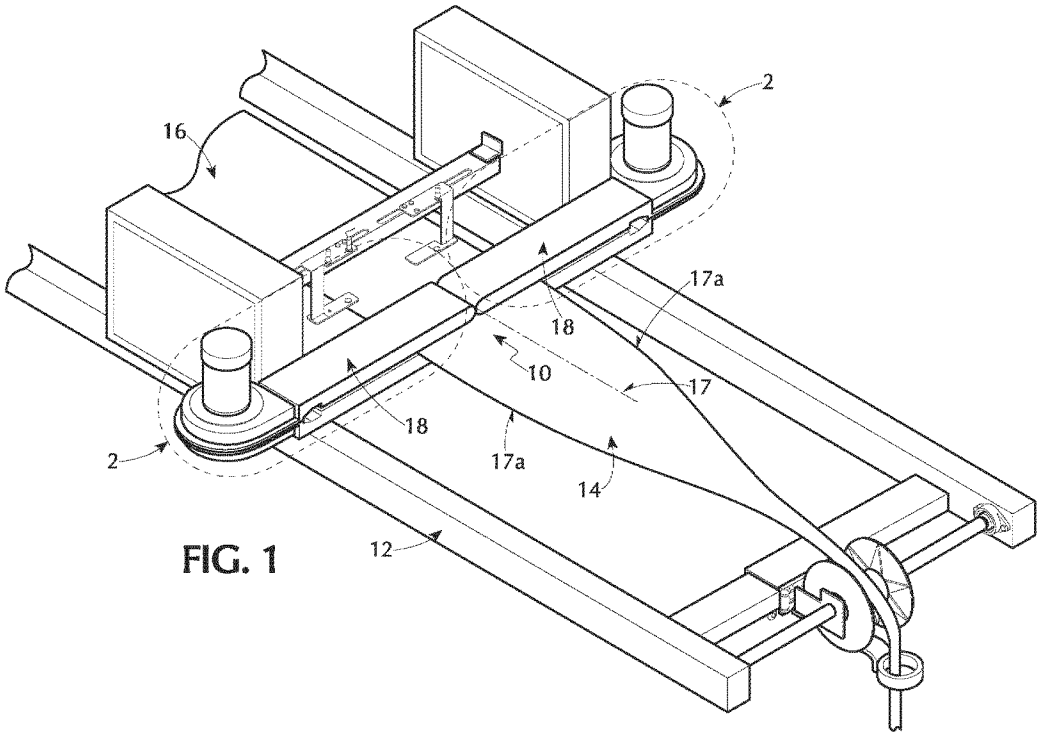

| | | | | | |
|---|---|---|---|---|---|
| 3,281,957 | A | * | 11/1966 | Ranney | B29B 13/023 226/196.1 |
| 3,632,030 | A | | 1/1972 | Cohn | |
| 3,688,354 | A | | 9/1972 | Cohn | |
| 3,709,076 | A | * | 1/1973 | Kissell | D04H 1/00 226/196.1 |
| 3,873,013 | A | * | 3/1975 | Stibbe | B41F 23/0426 242/615.11 |
| 4,021,931 | A | * | 5/1977 | Russ | B65H 23/24 226/196.1 |
| 4,197,621 | A | * | 4/1980 | Mair | B65H 23/24 226/196.1 |
| 4,320,587 | A | * | 3/1982 | Vits | F26B 13/104 226/196.1 |
| 4,322,026 | A | | 3/1982 | Young | |
| 4,480,777 | A | * | 11/1984 | Suzuki | B65H 23/032 226/15 |
| 5,150,534 | A | * | 9/1992 | Kramer | C03B 27/0404 226/196.1 |
| 5,203,485 | A | | 4/1993 | Cahill | |
| 2013/0063587 | A1 | | 3/2013 | DeNoble | |
| 2015/0354120 | A1 | * | 12/2015 | Catallo | D06C 3/02 26/92 |

* cited by examiner

DEVICE FOR ALLOWING NARROW COLLAR MATERIAL TO BE PROCESSED THROUGH A STANDARD FABRIC COMPACTOR

1. BACKGROUND OF THE INVENTION

A. Field of the Invention

The embodiments of the present invention relate to a device for processing narrow collar material, and more particularly, the embodiments of the present invention relate to a device for allowing narrow collar material to be processed through a standard fabric compactor.

B. Description of the Prior Art

Numerous innovations for fabric processing machines have been provided in the prior art, which will be described below in chronological order to show advancement in the art, and which are incorporated herein in their entirety by reference thereto. Even though these innovations may be suitable for the specific individual purposes to which they address, nevertheless, they differ from the embodiments of the present invention.

(1) U.S. Pat. No. 2,747,250 to Bramhall Jr. et al.

U.S. Pat. No. 2,747,250—issued to Bramhall Jr. et al. on May 29, 1956 in U.S. class 26 and subclass 54 teaches an apparatus for uncurling the edges of a fabric having curved edges. The apparatus includes a vessel for containing a liquid through which the fabric is passed, guiding apparatus supported in the vessel for controlling the path of the fabric through the vessel, a guide plate supported in inclined relation to the vessel, apparatus for continuously feeding a fabric downwardly over the inclined guide plate to the vessel in a substantially untensioned condition, a pair of rotatable fluid conduits supported over the guide plate in spaced relation thereto, walls defining at least one fluid orifice in each of the conduits, apparatus for rotating each of the conduits on its axis to vary the angle at which fluid is discharged from the orifices against the fabric passing over the guide plate, and apparatus for simultaneously moving each of the conduits in a transverse path across, and above, the surface of the guide plate.

(2) U.S. Pat. No. 3,632,030 to Cohn et al.

U.S. Pat. No. 3,632,030—issued to Cohn et al. on Jan. 4, 1972 in U.S. class 326 and subclass 3 teaches an air-operated fabric-guiding system that is disposed along, and encompasses the edge portions of, a laterally disposed fabric. Sensors and actuators are for causing an outward discharge of air along the surface of the fabric in response to movement of the fabric from a predetermined course. The air emission on one side of the fabric causes a shifting of the fabric in a direction of the air emission, thereby realigning the fabric on the predetermined course.

(3) U.S. Pat. No. 3,688,354 to Cohn et al.

U.S. Pat. No. 3,688,354—issued to Cohn et al. on Sep. 5, 1972 in U.S. class 26 and subclass 59—teaches a method of processing open width fabrics, particularly distortable fabrics like those of knitted construction, in a rotary-type of tenter processor in which the fabric is acted upon by high velocity air streams. The fabric is first engaged by its opposed edge extremities and distended to a predetermined width, and remains so engaged throughout the processing operation. The engaged fabric is supplied to, and mechanically supported by, a synchronously rotating processing drum. The fabric, regardless of its width, is applied symmetrically to the center area of the drum and held by its edges at a uniform width regardless of the overall axial length of the drum that may be considerably greater than the width of a given fabric web. While the fabric is supported on the drum, high velocity streams extending over the full axial length of the drum and independent of the width of the fabric are directed radially through the fabric and drum to effect a desired processing.

(4) U.S. Pat. No. 4,322,026 to Young Jr.

U.S. Pat. No. 4,322,026 issued to Young Jr. on Mar. 30, 1982 in U.S. class 226 and subclass 15 teaches a method and apparatus for smoothing and laterally guiding a longitudinally moving web of material. The web is longitudinally moved in a generally upward vertical direction past first pressurized fluid discharge manifolds disposed adjacent the web path on either side of the plane of the web to continuously direct streams of pressurized fluid, such as air, outwardly of the central portion of the web and toward side edges of the web to smooth and remove wrinkles from the same, and then second pressurized fluid discharge manifolds located adjacent at least side edge portions of the web path for intermittently directing streams of air across opposite faces of the web toward one or the other of the side edges thereof in response to web edge sensing apparatus to laterally move and guide the web during its longitudinal travel.

(5) U.S. Pat. No. 5,203,485 to Cahill et al.

U.S. Pat. No. 5,203,485—issued to Cahill et al. on Apr. 20, 1993 in U.S. class 226 and subclass 97—teaches an air mover for producing a stream of air along a guide surface for conveying a web or other sheet material along a path adjacent the surface. The air mover includes two parts having mating surfaces, one of which includes a recess that defines a slot through which conveying and entraining air is delivered to the guide surface from an air pressure chamber within the air mover.

(6) United States Patent Application Publication Number US 2013/0063587A1 to DeNoble et al.

United States Patent Application Publication Number US 2013/0063587 A1 published to DeNoble et al. on Mar. 14, 2013 in U.S. class 348 and subclass 88 teaches apparatus and methods to minimize waste in web processing operations. The apparatus and methods allow defects to be detected by discerning a difference in the appearance from side-to-side with a vision camera. An acquisition inverter can flip the material to a correct orientation.

It is apparent that numerous innovations for fabric processing machines have been provided in the prior art, which are adapted to be used. Furthermore, even though these innovations may be suitable for the specific individual purposes to which they address, nevertheless, they would not be suitable for the purposes of the embodiments of the present invention as heretofore described.

2. SUMMARY OF THE INVENTION

Thus, an object of the embodiments of the present invention is to provide a device for allowing narrow collar material to be processed through a standard fabric compactor, which avoids the disadvantages of the prior art.

Briefly stated, another object of the embodiments of the present invention is to provide a device that attaches to a standard fabric compactor and allows narrow collar material to be processed through the standard fabric compactor. The device includes a pair of air openers. Each air opener includes an air inlet assembly and an air outlet assembly. The air inlet assembly of each air opener pulls air therein to form pulled air and pressurizes the pulled air to form pressurized air. The air outlet assembly of each air opener fluidly communicates with the air inlet assembly of an associated air opener, receives the narrow collar material therethrough, receives the pressurized air from the air inlet assembly of the associated air opener, and directs the pressurized air onto the narrow collar material, simultaneously from above and below, and in doing so, suspends the narrow collar material allowing the narrow collar material to be processed through the standard fabric compactor.

The novel features considered characteristic of the embodiments of the present invention are set forth in the appended claims. The embodiments of the present invention themselves, however, both as to their construction and to their method of operation together with additional objects and advantages thereof will be best understood from the following description of the embodiments of the present invention when read and understood in connection with the accompanying figures of the drawing.

3. BRIEF DESCRIPTION OF THE FIGURES OF THE DRAWING

Figure 2:
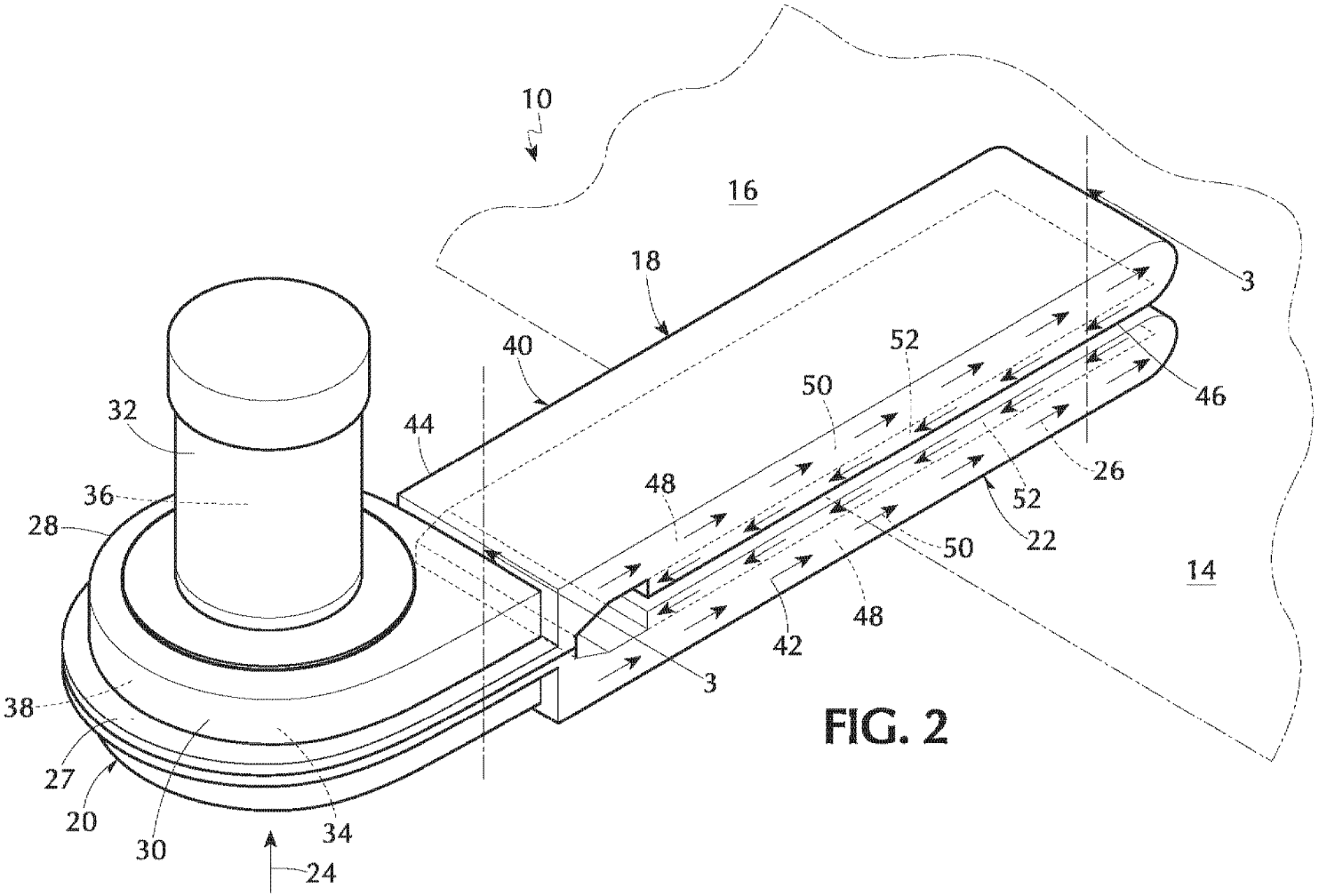
Figure 3:
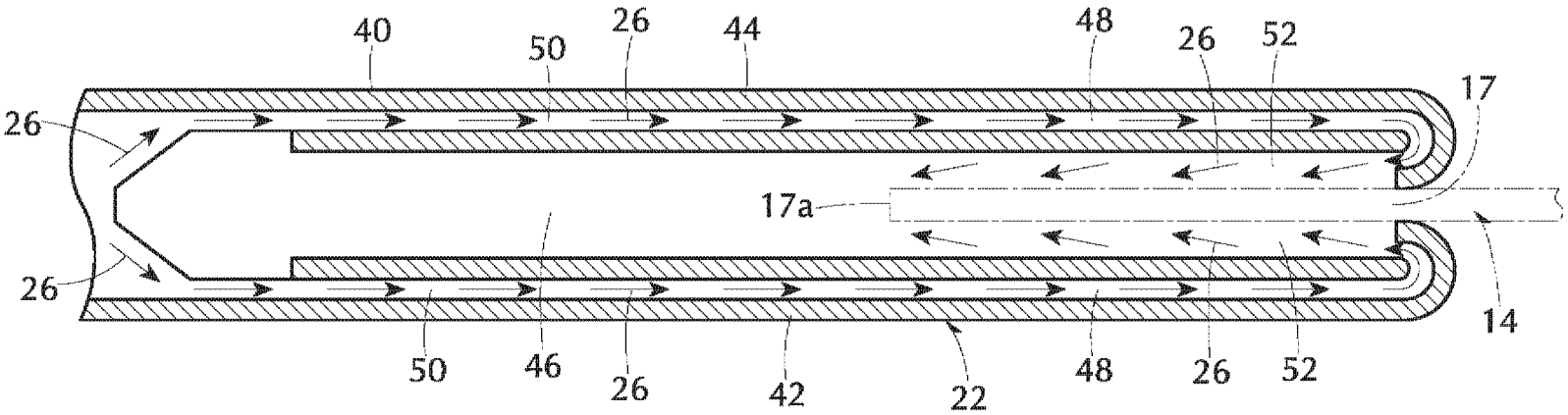

The figures of the drawing are briefly described as follows:

FIG. 1 a diagrammatic perspective view of the device of the embodiments of the present invention allowing narrow collar material to be processed through a standard fabric compactor;

FIG. 2 is an enlarged diagrammatic perspective view of the areas generally enclosed by the dotted ellipses identified by ARROWS 2 in FIG. 1 of each of the pair of air openers of the device of the embodiments of the present invention; and FIG. 3 is an enlarged diagrammatic cross sectional view taken along LINE 3-3 in FIG. 2.

4. LIST OF REFERENCE NUMERALS UTILIZED IN THE FIGURES OF THE DRAWING

A. Introductory

10 device of embodiments of present invention for attaching to standard fabric compactor 12 and for allowing narrow collar material 14 to be processed through standard fabric compactor 12

12 standard fabric compactor

14 narrow collar material

18 pair of air openers for attaching transversely to standard fabric compactor 12, for positioning transversely to path of narrow collar material 14, and for allowing narrow collar material 14 to be processed through standard fabric compactor 16

B. Overall Configuration of Pair of Air Openers 18

20 air inlet assembly of each air opener of pair of air openers 18 for pulling air therein to form pulled air 24 and for pressurizing pulled air 24 to form pressurized air 26

22 air outlet assembly of each air opener of pair of air openers 18 for receiving narrow collar material 14 therethrough

24 pulled air

26 pressurized air

C. Specific Configuration of Air Inlet Assembly 20 of Each Air Opener 18

27 blower assembly of air inlet assembly 20 of each air opener of pair of air openers 18

28 inlet housing of blower assembly 27 of air inlet assembly 20 of each air opener of pair of air openers 18

30 impeller housing of inlet housing 28 of blower assembly 27 of air inlet assembly 20 of each air opener of pair of air openers 18

32 motor housing of inlet housing 28 of blower assembly 27 of air inlet assembly 20 of each air opener of pair of air openers 18

34 inlet opening of impeller housing 30 of inlet housing 28 of blower assembly 27 of air inlet assembly 20 of each air opener of pair of air openers 18 for pulling in pulled air 24

36 motor of blower assembly 27 of air inlet assembly 20 of each air opener of pair of air openers 18

38 impeller of blower assembly 27 of air inlet assembly 20 of each air opener of pair of air openers 18

D. Specific Configuration of Air Outlet Assembly 22 of Each Air Opener 18

40 bifurcated housing of air outlet assembly 22 of each air opener of pair of air openers 18

42 lower finger of bifurcated housing 40 of air outlet assembly 22 of each air opener of pair of air openers 18

44 upper finger of bifurcated housing 40 of air outlet assembly 22 of each air opener of pair of air openers 18

46 collar material-advancing through slot of bifurcated housing 40 of air outlet assembly 22 of each air opener of pair of air openers 18 for receiving narrow collar material 14 therethrough

48 conduit of each of upper finger 44 of bifurcated housing 40 of air outlet assembly 22 of each air opener of pair of air openers 18 and lower finger 42 of bifurcated housing 40 of air outlet assembly 22 of associated air opener of pair of air openers 18

50 outer leg of conduit 48 of each of upper finger 44 of bifurcated housing 40 of air outlet assembly 22 of each air opener of pair of air openers 18 and lower finger 42 of bifurcated housing 40 of air outlet assembly 22 of associated air opener of pair of air openers 18

52 inner leg of conduit 48 of each of upper finger 44 of bifurcated housing 40 of air outlet assembly 22 of each air opener of pair of air openers 18 and lower finger 42 of bifurcated housing 40 of air outlet assembly 22 of associated air opener of pair of air openers 18

5. DETAILED DESCRIPTION OF THE PREFERRED EMBODIMENTS

A. Introductory

Referring now to the figures, in which like numerals indicate like parts, and particularly to FIG. 1, the device of the embodiments of the present invention is shown generally at 10 for attaching to a standard fabric compactor 12 and for allowing narrow collar material 14 having a path to be processed through the standard fabric compactor 12.

The device 10 comprises a pair of air openers 18.

The pair of air openers 18 are identical to each other, oppose each other, are inline with each other, are for attaching transversely to the standard fabric compactor 12, are for positioning transversely to the path of the narrow collar material 14, and are for allowing the narrow collar material 14 to be processed through the standard fabric compactor 16.

B. Overall Configuration of the Pair of Air Openers 18

The configuration of each air opener 18 can best be seen in FIG. 2, and as such, will be discussed with reference thereto.

Each air opener 18 comprises an air inlet assembly 20 and an air outlet assembly 22. The air inlet assembly 20 of each air opener 18 is for pulling air therein to form pulled air 24 and for pressurizing the pulled air 24 to form pressurized air 26. The air outlet assembly 22 of each air opener 18 fluidly communicates with the air inlet assembly 20 of an associated air opener 18, is for receiving the narrow collar material 14 therethrough, receives the pressurized air 26 from the air inlet assembly 20 of the associated air opener 18, and directs the pressurized air 26 onto the narrow collar material 14, simultaneously from above and below, and in doing so, suspends the narrow collar material 14 allowing the narrow collar material 14 to be processed through the standard fabric compactor 16.

C. Specific Configuration of the Air Inlet Assembly 20 of Each Air Opener 18

The specific configuration of the air inlet assembly 20 of each air opener 18 can best be seen in FIG. 2, and as such, will be discussed with reference thereto.

The air inlet assembly 20 of each air opener 18 comprises a blower assembly 27. The blower assembly 27 of the air inlet assembly 20 of each air opener 18 comprises an inlet housing 28. The inlet housing 28 of the blower assembly 27 of the air inlet assembly 20 of each air opener 18 includes an impeller housing 30 and a motor housing 32.

The impeller housing 30 of the inlet housing 28 of the blower assembly 27 of the air inlet assembly 20 of each air opener 18 is disk-shaped, communicates with the air outlet assembly 22 of an associated air opener 18, and has an inlet opening 34 therebelow for pulling in the pulled air 24.

The motor housing 32 of the inlet housing 28 of the blower assembly 27 of the air inlet assembly 20 of each air opener 18 is cylindrical-shaped, and extends coaxially upwardly from, and communicates with, the impeller housing 30 of the inlet housing 28 of the blower assembly 27 of the air inlet assembly 20 of an associated air opener 18.

The blower assembly 27 of the air inlet assembly 20 of each air opener 18 further comprises a motor 36 and an impeller 38.

The impeller 38 of the blower assembly 27 of the air inlet assembly 20 of each air opener 18 is disposed in the impeller housing 30 of the inlet housing 28 of the blower assembly 27 of the air inlet assembly 20 of an associated air opener 18, and the motor 36 of the blower assembly 27 of the air inlet assembly 20 of the associated air opener 18 is disposed in the motor housing 32 of the inlet housing 28 of the blower assembly 27 of the air inlet assembly 20 of the associated air opener 18 and is operatively connected to the impeller 38 of the blower assembly 27 of the air inlet assembly 20 of the associated air opener 18 so when the motor 36 of the blower assembly 27 of the air inlet assembly 20 of the associated air opener 18 is activated, the impeller 38 of the blower assembly 27 of the air inlet assembly 20 of the associated air opener 18 spins pulling in the pulled air 24 through the inlet opening 34 of the impeller housing 30 of the inlet housing 28 of the blower assembly 27 of the air inlet assembly 20 of the associated air opener 18 and pressurizes the pulled air 24 to form the pressurized air 26 that exits the impeller housing 30 of the inlet housing 28 of the blower assembly 27 of the air inlet assembly 20 of the associated air opener 18 and enters into the air outlet assembly 22 of the associated air opener 18 for further processing.

D. Specific Configuration of the Air Outlet Assembly 22 of Each Air Opener 18

The specific configuration of the air outlet assembly 22 of each air opener 18 can best be seen in FIGS. 2 and 3, and as such, will be discussed with reference thereto.

The air outlet assembly 22 of each air opener 18 comprises a bifurcated housing 40, and as such, includes a lower finger 42 and an upper finger 44.

The bifurcated housing 40 of the air outlet assembly 22 of each air opener 18 extends communicatingly from the impeller housing 30 of the inlet housing 28 of the blower assembly 27 of the air inlet assembly 20 of an associated air opener 18.

The upper finger 44 of the bifurcated housing 40 of the air outlet assembly 22 of each air opener 18 is parallel to, and spaced above, the lower finger 42 of the bifurcated housing 40 of the air outlet assembly 22 of an associated air opener 18 so as to form therebetween a collar material-advancing through slot 46 for receiving the narrow collar material 14 therethrough.

Each of the upper finger 44 of the bifurcated housing 40 of the air outlet assembly 22 of each air opener 18 and the lower finger 42 of the bifurcated housing 40 of the air outlet assembly 22 of an associated air opener 18 is straight, flat, shallow, and is as wide as the impeller housing 30 of the inlet housing 28 of the blower assembly 27 of the air inlet assembly 20 of the associated air opener 18.

Each of the upper finger 44 of the bifurcated housing 40 of the air outlet assembly 22 of each air opener 18 and the lower finger 42 of the bifurcated housing 40 of the air outlet assembly 22 of an associated air opener 18 contains a conduit 48 having a shape. The conduit 48 of each of the upper finger 44 of the bifurcated housing 40 of the air outlet assembly 22 of the associated air opener 18 and the lower finger 42 of the bifurcated housing 40 of the air outlet assembly 22 of the associated air opener 18 communicates with the impeller housing 30 of the inlet housing 28 of the blower assembly 27 of the air inlet assembly 20 of the associated air opener 18.

The conduit 48 of each of the upper finger 44 of the bifurcated housing 40 of the air outlet assembly 22 of each air opener 18 and the lower finger 42 of the bifurcated housing 40 of the air outlet assembly 22 of an associated air opener 18 extends outwardly therealong, as an outer leg 50, and then reverses 180° to extend back inwardly therealong, as an inner leg 52, that is adjacent to, and communicates with, the collar material-advancing through slot 46 of the bifurcated housing 40 of the air outlet assembly 22 of the associated air opener 18.

The pressurized air 26 exits the impeller housing 30 of the inlet housing 28 of the blower assembly 27 of the air inlet assembly 20 of each air opener 18, flows outwardly through the outer leg 50 of the conduit 48 of each of the upper finger 44 of the bifurcated housing 40 of the air outlet assembly 22 of an associated air opener 18 and the lower finger 42 of the bifurcated housing 40 of the air outlet assembly 22 of the associated air opener 18, and then automatically reverses 180°—by virtue of the shape of the conduit 48 of each of the upper finger 44 of the bifurcated housing 40 of the air outlet assembly 22 of the associated air opener 18 and the lower finger 42 of the bifurcated housing 40 of the air outlet assembly 22 of the associated air opener 18—to flow back inwardly through the inner leg 52 of the conduit 48 of each of the upper finger 44 of the bifurcated housing 40 of the air outlet assembly 22 of the associated air opener 18 and the lower finger 42 of the bifurcated housing 40 of the air outlet assembly 22 of the associated air opener 18 fluidly communicating with the collar material-advancing through slot 46 of the bifurcated housing 40 of the air outlet assembly 22 of the associated air opener 18 to direct the pressurized air 26 onto the narrow collar material 14, simultaneously from above and below, and in doing so, suspends the narrow collar material 14 allowing the narrow collar material 14 to be processed through the standard fabric compactor 16.

E. Impressions

It will be understood that each of the elements described above or two or more together may also find a useful application in other types of constructions differing from the types described above.

While the embodiments of the present invention have been illustrated and described as embodied in a fabric modality altering device for attaching to a horizontal frame and for transitioning a roped fabric to a flat web, nevertheless, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis, the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A device for attaching to a fabric compactor and for allowing collar material having a path to be processed through the fabric compactor, comprising a pair of air openers;

wherein each air opener comprises:

a) an air inlet assembly; and b) an air outlet assembly;

wherein said air inlet assembly of each air opener is for pulling air therein to form pulled air;

wherein said air inlet assembly of each air opener is for pressurizing said pulled air to form pressurized air;

wherein said air outlet assembly of each air opener fluidly communicates with said air inlet assembly of an associated air opener;

wherein said air outlet assembly of each air opener is for receiving the collar material therethrough;

wherein said air outlet assembly of each air opener receives said pressurized air from said air inlet assembly of an associated air opener;

wherein said air outlet assembly of each air opener directs said pressurized air onto the collar material, simultaneously from above and below, and in doing so, suspends the collar material allowing the collar material to be processed through the fabric compactor;

wherein said air inlet assembly of each air opener comprises a blower assembly;

wherein said blower assembly of said air inlet assembly of each air opener comprises an inlet housing;

wherein said inlet housing of said blower assembly of said air inlet assembly of each air opener includes:

a) an impeller housing; and b) a motor housing;

wherein said motor housing of said inlet housing of said blower assembly of said air inlet assembly of each air opener extends coaxially upwardly from said impeller housing of said inlet housing of said blower assembly of said air inlet assembly of an associated air opener; and wherein said motor housing of said inlet housing of said blower assembly of said air inlet assembly of each air opener communicates with said impeller housing of said inlet housing of said blower assembly of said air inlet assembly of an associated air opener.

2. The device of claim 1, wherein said pair of air openers are identical to each other;

wherein said pair of air openers oppose each other;

wherein said pair of air openers are inline with each other;

wherein said pair of air openers are for attaching transversely to the fabric compactor;

wherein said pair of air openers are for positioning transversely to the path of the Collar material; and wherein said pair of air openers are for allowing the collar material to be processed through the fabric compactor.

3. The device of claim 1, wherein said impeller housing of said inlet housing of said blower assembly of said air inlet assembly of each air opener is disk-shaped.

4. The device of claim 1, wherein said impeller housing of said inlet housing of said blower assembly of said air inlet assembly of each air opener communicates with said air outlet assembly of an associated air opener;

wherein said impeller housing of said inlet housing of said blower assembly of said air inlet assembly of each air opener has an inlet opening therebelow; and wherein said inlet opening of said impeller housing of said inlet housing of said blower assembly of said air inlet assembly of each air opener is for pulling in said pulled air.

5. The device of claim 1, wherein said motor housing of said inlet housing of said blower assembly of said air inlet assembly of each air opener is cylindrical-shaped.

6. The device of claim 4, wherein said blower assembly of said air inlet assembly of each air opener comprises:

a) a motor; and b) an impeller.

7. The device of claim 6, wherein said impeller of said blower assembly of said air inlet assembly of each air opener is disposed in said impeller housing of said inlet housing of said blower assembly of said air inlet assembly of an associated air opener.

8. The device of claim 6, wherein said motor of said blower assembly of said air inlet assembly of each air opener is disposed in said motor housing of said inlet housing of said blower assembly of said air inlet assembly of an associated air opener; and wherein said motor of said blower assembly of said air inlet assembly of each air opener is operatively connected to said impeller of said blower assembly of said air inlet assembly of an associated air opener.

9. The device of claim 6, wherein when said motor of said blower assembly of said air inlet assembly of each air opener is activated, said impeller of said blower assembly of said air inlet assembly of an associated air opener spins pulling in said pulled air through said inlet opening of said impeller housing of said inlet housing of said blower assembly of said air inlet assembly of said associated air opener and pressurizes said pulled air to form said pressurized air that exits said impeller housing of said inlet housing of said blower assembly of said air inlet assembly of said associated air opener and enters into said air outlet assembly of said associated air opener for further processing.

10. The device of claim 1, wherein said air outlet assembly of each air opener comprises a bifurcated housing; and wherein said bifurcated housing of said air outlet assembly of each air opener includes:

a) a lower finger; and b) an upper finger.

11. The device of claim 10, wherein said bifurcated housing of said air outlet assembly of each air opener extends communicatingly from said impeller housing of said inlet housing of said blower assembly of said air inlet assembly of an associated air opener.

12. The device of claim 10, wherein said upper finger of said bifurcated housing of said air outlet assembly of each air opener is parallel to said lower finger of said bifurcated housing of said air outlet assembly of an associated air opener;

wherein said upper finger of said bifurcated housing of said air outlet assembly of each air opener is spaced above said lower finger of said bifurcated housing of said air outlet assembly of an associated air opener so as to form therebetween a collar material-advancing through slot; and wherein said collar material-advancing through slot of said bifurcated housing of said air outlet assembly of each air opener is for receiving the collar material therethrough.

13. The device of claim 10, wherein each of said upper finger of said bifurcated housing of said air outlet assembly of each air opener and said lower finger of said bifurcated housing of said air outlet assembly of an associated air opener is straight;

wherein each of said upper finger of said bifurcated housing of said air outlet assembly of each air opener and said lower finger of said bifurcated housing of said air outlet assembly of an associated air opener is flat;

wherein each of said upper finger of said bifurcated housing of said air outlet assembly of each air opener and said lower finger of said bifurcated housing of said air outlet assembly of an associated air opener is shallow; and wherein each of said upper finger of said bifurcated housing of said air outlet assembly of each air opener and said lower finger of said bifurcated housing of said air outlet assembly of an associated air opener is as wide as said impeller housing of said inlet housing of said blower assembly of said air inlet assembly of said associated air opener.

14. The device of claim 12, wherein each of said upper finger of said bifurcated housing of said air outlet assembly of each air opener and said lower finger of said bifurcated housing of said air outlet assembly of an associated air opener contains a conduit; and wherein said conduit of each of said upper finger of said bifurcated housing of said air outlet assembly of each air opener and said lower finger of said bifurcated housing of said air outlet assembly of an associated air opener has a shape.

15. The device of claim 14, wherein said conduit of each of said upper finger of said bifurcated housing of said air outlet assembly of each air opener and said lower finger of said bifurcated housing of said air outlet assembly of an associated air opener communicates with said impeller housing of said inlet housing of said blower assembly of said air inlet assembly of said associated air opener.

16. The device of claim 14, wherein said conduit of each of said upper finger of said bifurcated housing of said air outlet assembly of each air opener and said lower finger of said bifurcated housing of said air outlet assembly of an associated air opener extends outwardly therealong, as an outer leg, and then reverses 180° to extend back inwardly therealong, as an inner leg, that is adjacent to, and communicates with, said collar material-advancing through slot of said bifurcated housing of said air outlet assembly of said associated air opener.

17. The device of claim 16, wherein said pressurized air exits said impeller housing of said inlet housing of said blower assembly of said air inlet assembly of each air opener, flows outwardly through said outer leg of said conduit of each of said upper finger of said bifurcated housing of said air outlet assembly of an associated air opener and said lower finger of said bifurcated housing of said air outlet assembly of said associated air opener, and then automatically reverses 180° by virtue of said shape of said conduit of each of said upper finger of said bifurcated housing of said air outlet assembly of said associated air opener and said lower finger of said bifurcated housing of said air outlet assembly of said associated air opener to flow back inwardly through said inner leg of said conduit of each of said upper finger of said bifurcated housing of said air outlet assembly of said associated air opener and said lower finger of said bifurcated housing of said air outlet assembly of said associated air opener fluidly communicating with said collar material-advancing through slot of said bifurcated housing of said air outlet assembly of said associated air opener to direct said pressurized air onto the collar material, simultaneously from above and below, and in doing so, suspends the collar material allowing the collar material to be processed through the fabric compactor.

* * * * *